United States Patent [19]

Grimley

[11] 4,155,595

[45] May 22, 1979

[54] MINING METHOD AND APPARATUS

[75] Inventor: Arthur W. T. Grimley, Fernie, Canada

[73] Assignee: Kaiser Resources, Ltd., Vancouver, Canada

[21] Appl. No.: 875,488

[22] Filed: Feb. 6, 1978

Related U.S. Application Data

[63] Continuation of Ser. No. 773,159, Mar. 1, 1977, abandoned, which is a continuation of Ser. No. 597,986, Jul. 22, 1975, abandoned.

[51] Int. Cl.[2] ..... E21C 41/04

[52] U.S. Cl. ..... 299/18

[58] Field of Search ..... 193/6; 299/7, 8, 9, 299/18, 17; 306/14, 15; 61/14, 15; 198/595

[56] References Cited

U.S. PATENT DOCUMENTS

| | | | |
|---|---|---|---|
| 1,856,836 | 5/1932 | Howell | 299/17 X |
| 2,032,428 | 3/1936 | McCarthy | 198/595 |
| 3,924,895 | 12/1975 | Leasure | 299/18 |
| 4,031,797 | 6/1977 | Nelson | 198/303 |

*Primary Examiner*—William Pate, III

*Attorney, Agent, or Firm*—Schuyler, Birch, Swindler, McKie & Beckett

[57] ABSTRACT

A continuous miner is employed in conjunction with a flume that removes the mined product from the working face. The discharge from mobile continuous miner is deposited in a sloping trough supported by the miner which is in cooperative and relatively movable engagement with the flume and the product is washed down the trough with water which forms a slurry that is transported down the flume.

7 Claims, 7 Drawing Figures

MINING METHOD AND APPARATUS

This is a continuation of application Ser. No. 773,159, filed Mar. 1, 1977 which is a continuation of application Ser. No. 597,986 filed July 22, 1975 and now abandoned.

BACKGROUND OF THE INVENTION

This invention relates to the mining of friable materials and, more particularly, relates to the mining of friable materials with a continuous miner.

For ease of presentation, this invention will be described in terms of coal.

Continuous miners have found widespread use in the mining of coal, because of the increased production they provide. Generally, the miner includes a conveyor that discharges coal to the rear. That coal commonly is discharged into cars and the coal is transported away from the working area in the cars. Transport of coal as a coal/water slurry in flumes offers potential economic advantages but since a flume is stationary, it is not readily adaptable for use with a mobile continuous miner which not only moves from side to side but also moves forward and backward, to some extent, while mining coal.

It is an object of this invention to provide a method and apparatus whereby material may be readily transported from a continuous miner out of an entry through a flume as a solids/water slurry.

It is a further object of this invention to provide a method and apparatus whereby a mobile continuous miner is directly coupled with a fixed flume.

In one aspect of this invention, there is provided a method of mining materials which comprises:

(1) removing material from the working face of a mine with a continuous miner;

(2) discharging the mined material from the continuous miner into a trough supported by the miner and sloping away from said miner, and having its lower end in cooperative and relatively movable engagement with a flume, said trough being supplied near its upper end at a point above which the material is discharged into it with a flow of water sufficient to carry the material down the trough to said flume; and (3) transporting said material from the working area as a solids/water slurry in said flume.

In another aspect of this invention, there is provided a system which comprises:

(1) a continuous miner with conveyor means to discharge the mined material therefrom;

(2) a sloping flume to transport material from the working area as a solids/water slurry;

(3) a trough supported by said continuous miner and sloping away from said miner, said trough having its upper end positioned below said miner discharge conveyor to receive mined material and having its lower end in cooperative and relatively movable engagement with said flume, and (4) water supply means to said trough to supply water near the upper end of said trough at a point above which material is discharged from the miner conveyor into said trough.

By practice of this invention it is possible to connect a fixed flume to a mobile continuous miner in a practical and economic manner. The trough is inexpensive to manufacture yet is very reliable in operation. When compared to a system wherein coal was discharged from a continuous miner into cars and the coal from the cars was then dumped into a flume system the practice of this invention permitted a nine man crew to be reduced to a six man crew. It has been demonstrated that about 50% increase in feet of entry mined per man shift was achieved.

For a flume system to be feasible it is generally necessary to create a gradient of at least 7°±3°. Accordingly, shafts or entries driven by the continuous miner should have such a gradient. This presents no problem since continuous miners are readily capable of working on such gradients or slopes.

Flumes are known in the art and may be made of steel, concrete, wood or the like. When using steel flumes, the flume sections may be welded but such measures are not necessary. If the uphill section slightly overlaps the downhill section the momentum of the water moving downhill substantially precludes leakage.

The coal/water slurry for transport through a sloping flume will generally have a coal:water ratio of about 1:4 to about 1:0.5 and the coal size is generally not over about ½ the width of the flume. Since coal in smaller sizes is easier to transport in a flume, it is desirable to crush the coal as fine as possible at the face. Therefore, the continuous miner used in the practice of this invention desirably includes breaking means. A simple notched bar placed above the teeth of the miner at a point just prior to the transfer of the coal to the conveyor on the miner has effectively been employed. The use of a roll crusher in cooperation with the conveyor on the miner is also contemplated by this invention.

Desirably the coal is broken so that the maximum size of the lumps is generally less than about one-half the width of the flume. Preferably the coal is broken so that the maximum dimension of the larger lumps is less than about 6 inches, and most preferably, less than about 4 inches. It should be understood that some of the coal may be fine and that some pieces may be larger than the sizes discussed above. The flume can handle occasional pieces which have a maximum dimension slightly less than the width of the flume.

The trough employed in this invention is suspended from the continuous miner beneath the discharge end of the conveyor. The trough preferably is suspended by chains, cables or the like which permit some movement of the trough relative to the conveyor. Alternatively the trough can be supported on a pivot mounted from the continuous miner. The trough is desirably at least as wide at its upper end as the width of the conveyor although a funnel can be employed, if desired, to restrict the flow of coal as it leaves the conveyor and thereby permit the use of a trough which is narrower at its upper end than the conveyor width.

The lower end of the trough is in cooperative and relatively movable engagement with the flume. This may be accomplished by employed a trough with a lower end that is somewhat narrower than the flume width. The lower end of the trough is merely placed in the flume and allowed to slide up or down the flume as the continuous miner moves. Alternatively the lower end of the trough may be equipped with rollers that contact the interior of the flume or the lower end of the trough may be suspended from rollers or wheels that ride along the edges of the trough.

The momentum of the coal/water slurry carries it down the flume and substantially no water backs up the flume even though there is a clearance between the sides of the trough and the sides of the flume. The amount of clearance needed can be determined readily. A clearance of one inch on each side has been found to entirely satisfactory but smaller or larger clearances can be employed depending on trough and flume size, materials of construction or the like.

Often, flumes are located near one wall of the shaft or entry to permit as much access as possible up and down the entry. In such case, the trough is offset to permit the continuous miner to be positioned at and across the center of the entry. In order to provide the offset, the trough may be curved or may contain one or more angles. Since an entry may be 16 feet or or more wide and a continuous miner may work at the far edge of the entry from the flume, the offset between the miner centerline and the flume may be as much as 10 feet or more.

The invention may be better understood by reference to the attached drawings.

Figure 1:
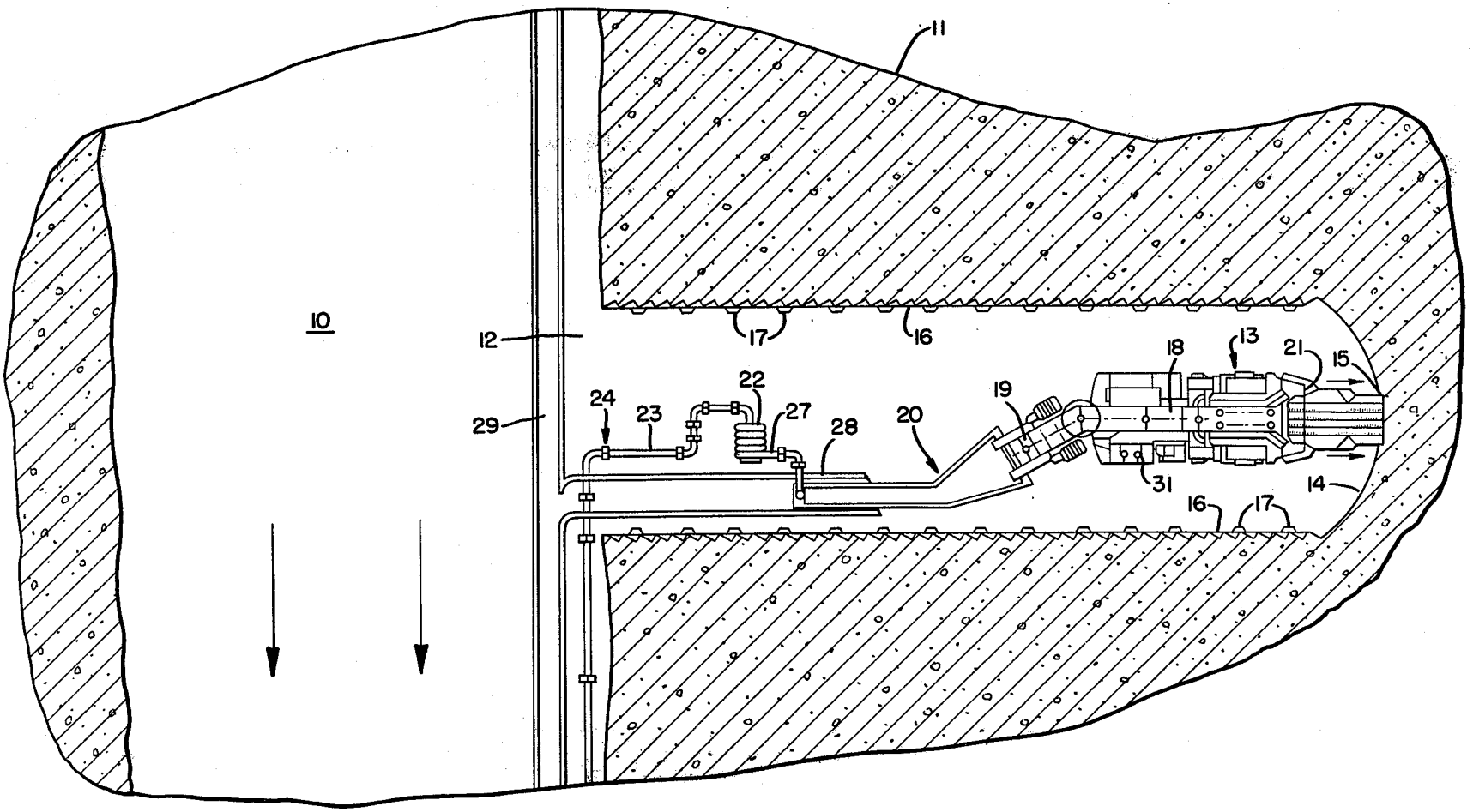
FIG. 1 is a general view in plan illustrating the mining of an entry into a bed of coal by a continuous mining machine and associated trough and flume.

In the drawings, referring to FIG. 1 the reference 10 represents a roadway in a coal mine and 11 represents a bed of coal which, as shown, is to be mined as hereinafter disclosed. The roadway 10 slopes down hill, as best indicated by the arrows.

The entry 12 is mined, utilizing a continuous mining machine 13 which progresses into the entry from the roadway mining coal from the working face that is here indicated by the reference 14. The continuous mining machine includes apparatus for mechanically mining coal as represented at 15 and which forms the entry as the machine proceeds into the bed of coal.

As the continuous mining machine 13 proceeds into the coal bed 11 in preparing the entry, the entry is progressively lined with wood or metal sheets 16 which are reinforced by beams 17 to provide stability in the entry thus formed. The mechanical mining apparatus 15 is movable in an arcuate path from side to side and to the front of the machine 13 as the operation of mining the entry is performed from a position that is centrally disposed transversely of the entry. The mined coal dug out of the bed 11 by the mechanical apparatus 15 is passed beneath breaker bar 21 and is deposited on a conveyor mechanism 18 included on the machine 13 and is conveyed to the rear of the mining machine where it is discharged into trough 20. The conveyor 18 is provided with an angularly disposed section 19 for transporting the mined coal laterally to the extent necessary to deposit the coal into the trough from the centrally positioned location of the continuous mining machine. The section 19 may also be raised or lowered as desired. The mining machine 13 is provided with suitable means to propel the machine and to power the driving mechanism for the mining apparatus 15 and the conveyor 18 such as fully enclosed motors with suitable armored power lines thereto. Controls 31 are provided on the continuous mining machine for regulating the several operating functions thereof by an operator at the side of the machine.

Water is added to the mined coal as it is transported through the trough 20 to form a coal/water slurry that is transported out of the entry 12 through flume 28. A water line comprised of a plurality of pipe sections 23 secured together by quick acting joint clamps or couplings 24 extends into the entry 12 from a suitable source for the water which is supplied under pressure. Additional water may be added in the flume if desired.

The pipe line conducts the water to a point back of the trailing end of the trough where a section of flexible pressure tubing connects the water to header 25 on the trough. The flexible hose may be wound on reel 22 to avoid an excess of hose on the floor. The water delivery to the trough will be described in more detail with respect to FIGS. 2 and 3 below.

The coal/water slurry from the trough 20 discharges into a flume 28 which may be metal or other suitable materials located in or on the floor of the entry 12 and leading out of the entry to the roadway 10 and which transports the slurry out of the entry continuously as the coal is removed from the coal bed 11 by the operation of the continuous mining machine. The flume 28 is provided in or on the floor of the entry and preferably is made of or lined with metal sections as the entry 12 is prepared and at the roadway 10 this flume empties into a similar flume 29 that transports the coal/water slurry to a dewatering plane where the coal and water are separated and the water recirculated for use in the line 23.

Figure 2:
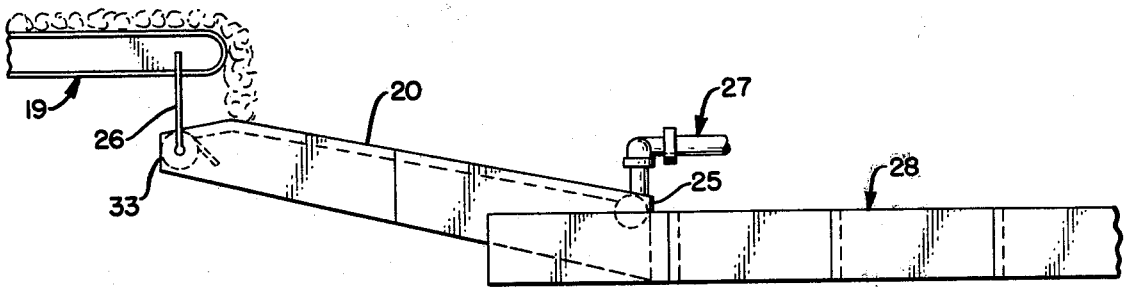
FIG. 2 is an elevation showing the continuous miner discharge conveyor, the trough and the flume.
Figure 3:
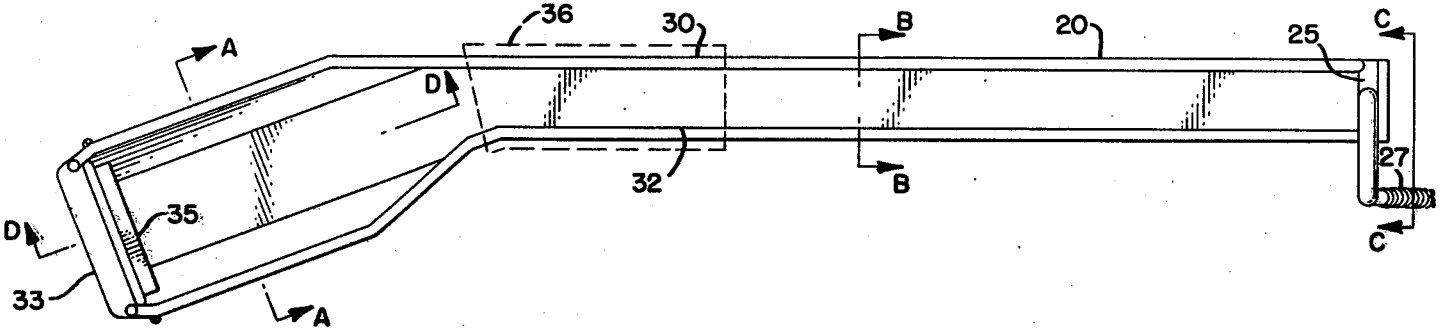
FIG. 3 is a detail drawing of a trough with associated piping.

Referring to FIGS. 2 and 3, the trough 20 is suspended, as by chains 26 to each side from conveyor 19. The slope of the trough can, therefore, be controlled by raising or lowering the discharge end of conveyor 19.

Water from line 23 is passed through flexible conduit 27 to header 25 near the trailing edge of trough 20. In the embodiment shown, two lines 30 and 32 carry the water along each of the edges of trough 20 to a header 33 near the upper end of the trough. These lines form a lip which assists in keeping the flow in the trough and adds structural strength to the tough. The lines can be located elsewhere but in such event it is desirable although not necessary to provide a lip on each side of the trough to prevent or minimize splashing. Header 33 is provided with slots 34 to direct the water down the trough. The header 33 is provided with deflector plate 35 to minimize generation of the water spray. As shown in FIG. 3 the trough includes an angle of about 20° to provide a lateral off-set which permits the miner to be located in the center of the entry and the flume to be positioned along one wall of the entry. At the bend in the trough, the water may tend to form some spray. If such condition exists it may readily be remedied merely by placing a cover over at least such portion of the trough. Such a cover is shown in dotted lines as 36 in FIG. 3.

Figure 3B:
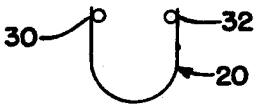
Figure 3C:
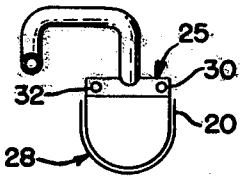
Figure 3D:
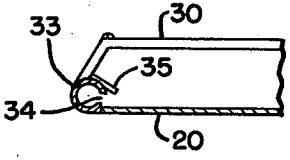
Figure 3A:
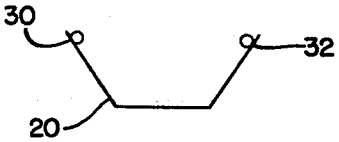

Details of the trough are shown in FIGS. 3*a* through 3*b* which are sections taken at A—A through D—D respectively.

In the embodiment shown, the inlet pipe 28 and header 25 were 4" pipe and flexible conduit 27 was 4" flexible hose. Lines 30 and 32 along the edges of the trough were 2½" diameter pipe and header 33 was an 8" pipe the horizontal slots 34 cut along header 33 to insure a distribution of water entirely across the trough had a total area of 11 square inches, which was approximately the cross-section of header 33. The arrangement was capable of discharging up to 1500 gpm of water into the trough. It is very desirable to have the water sufficiently distributed across the bottom of the trough to insure that coal falling onto the trough will be swept away.

The conveyor on the miner had a width of 28" with a support on each side 4" wide. The width of the steel trough beneath the conveyor was 41". As shown in FIG. 3*a*, the trough, under the conveyor, had sloping sides and a flat bottom. The bottom was 20 inches wide and the walls extended 16 ½ inches above the bottom. As shown in FIG. 3*b*, the cross section of the trough changed to a generally arcuate bottom with generally vertical walls. At that point the width of the trough was 18". At its trailing edge the trough, 18" wide, rested in the flume 28 which was 20" wide. The vertical height of the flume was 24". The lower section of the trough was 16 feet long at which point the trough turned laterally at an angle of about 20°. The angled portion of the trough was about 7 feet 6 inches long.

The off-set of the trough coupled with the angle of conveyor 19 permitted the continuous miner to be operated in the center of the entry while discharging coal into a flume located along the side of the entry. Even though the clearance between the trough width and the flume width is only about 2", the trough readily moved up and down the flume as the miner moved backward and forward. The flexibility provided by the chain suspension coupled with sliding relationship between the trough and flume provided reliable operation even with the off-set between the continuous miner and the flume. Since the trough slopes upwardly it readily rides across the seams between the adjoining flume sections when the miner moves forward, and since each flume section overlaps the next adjacent lower flume section there are no sharp seams to be encountered by the trough when the continuous miner backs up.

While this invention has been described in terms of coal, it is more broadly applicable to materials. Friable carbonaceous materials, such as coal, tar sands, gilsonite and the like, are preferred for the purpose of this invention while coal is particularly preferred.

I claim:

1. A method of driving a mine entry, said method comprising the steps of:

(1) removing material from the face within which the entry is to be formed by means of a continuous mechanical miner which moves forwardly, rearwardly and from side-to-side as it mines material from the face of said entry in a generally dry state;

(2) breaking oversized mined material in the miner;

(3) discharging mined material from the miner;

(4) receiving the mined material discharged from the miner in a tough of fixed length supported on the miner for relative movement therewith; said trough sloping away from the miner and having its upper end positioned to receive mined material from the miner;

(5) supplying water to said trough at a point above which mined material is discharged into the trough in an amount sufficient to form a solids/water slurry in the trough and carry mined material down the trough;

(6) discharging the solids/water slurry from the trough into a stationary flume sloping away from the miner by disposing the lower end of the trough in slidable engagement with the flume; whereby said trough and flume are maintained in continuous communication as the miner moves toward the face being worked and as the miner moves rearwardly and from side-to-side as required for driving the entry; and (7) transporting mined material from the working area as a solids/water slurry in said flume.

2. The method of claim 1 wherein the flume is located adjacent the side of the entry being driven and the trough contains a lateral off-set to accommodate positioning of the miner at a location disposed centrally of the width of the entry.

3. The method of claim 1 wherein breaking is effected with a roll crusher.

4. The method of claim 1 wherein the material mined is friable carbonaceous material.

5. The method of claim 1 wherein the material mined is coal.

6. The method of claim 1 wherein the flume is made up of sections and progressively extended as the continuous miner operates to extend the entry.

7. The method of claim 1 wherein the lower end of said trough rides within said flume and is at least about 2" narrower than said flume.

* * * * *